US007413361B2

(12) United States Patent
Kawaguchi

(10) Patent No.: US 7,413,361 B2
(45) Date of Patent: Aug. 19, 2008

(54) RECORDING APPARATUS AND CONTROL METHOD THEREOF

(75) Inventor: Koichiro Kawaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 452 days.

(21) Appl. No.: 11/256,109

(22) Filed: Oct. 24, 2005

(65) Prior Publication Data

US 2006/0098073 A1 May 11, 2006

(30) Foreign Application Priority Data

Nov. 5, 2004 (JP) ..... 2004-322576

(51) Int. Cl.
*B41J 2/01* (2006.01)
*B41J 13/02* (2006.01)

(52) U.S. Cl. ..... 400/636; 400/625; 347/104; 347/14

(58) Field of Classification Search ..... 347/104
See application file for complete search history.

(56) References Cited

U.S. PATENT DOCUMENTS

| | | | | |
|---|---|---|---|---|
| 5,982,400 | A | 11/1999 | Yokoi et al. | 346/134 |
| 6,092,893 | A | 7/2000 | Yokoi et al. | 347/104 |
| 6,170,817 | B1 | 1/2001 | Kawaguchi | 271/167 |
| 6,257,692 | B1 | 7/2001 | Yokoi et al. | 347/16 |
| 6,318,855 | B1 | 11/2001 | Kawaguchi | 347/104 |
| 6,761,425 | B2 | 7/2004 | Kawaguchi et al. | 347/16 |
| 6,909,447 | B2 | 6/2005 | Kawaguchi et al. | 347/218 |
| 6,939,064 | B2 | 9/2005 | Kawaguchi et al. | 400/283 |
| 2002/0126192 | A1 | 9/2002 | Kawaguchi et al. | 347/104 |
| 2005/0041054 | A1 | 2/2005 | Kawaguchi | 347/19 |
| 2006/0098073 | A1 | 5/2006 | Kawaguchi | 347/104 |

FOREIGN PATENT DOCUMENTS

| | | |
|---|---|---|
| JP | 2002-254736 | 9/2002 |

*Primary Examiner*—Leslie J Evanisko
(74) *Attorney, Agent, or Firm*—Fitzpatrick, Cella, Harper & Scinto

(57) ABSTRACT

When the trailing edge of a recording sheet is released from a nip of a first pair of rollers which hold and convey the recording sheet, on the upstream side in the conveyance path, a variance of electric power for driving the first pair of rollers is detected, and image data to be outputted to the print head is shifted to the upstream side in the conveyance direction of the recording sheet, so that the print head is driven. As a result, it is possible to prevent the positional shift of image due to the conveyance error of the recording sheet caused when the recording sheet is released from the nip.

21 Claims, 12 Drawing Sheets

IN NORMAL RECORDING

IN RECORDING AFTER PASS SWITCHING

IN RECORDING AFTER NOZZLE SHIFT

RECORDING APPARATUS AND CONTROL METHOD THEREOF

FIELD OF THE INVENTION

The present invention relates to a recording apparatus such as a printer, a copying machine, a facsimile and the like, and a control method thereof, and more particularly to the correction of a positional shift of an image recorded on a recording sheet due to a conveyance error of the recording sheet.

BACKGROUND OF THE INVENTION

Conventionally, in recording apparatuses, such as printers, copying machines and facsimiles, there are provided as conveyance means for conveying a recording sheet as a recording medium, a conveyance roller, a pinch roller which generates a conveying force by pressing the recording sheet against the conveyance roller, and means for generating a pressing force required by the pinch roller, and the like. Such conveyance means conveys the recording sheet supplied from a paper supplier to a recording area where recording is performed by a print head. The conveyance means generally includes two roller pairs at the front and back of the recording area, so that the recording sheet is held by each of the roller pairs and conveyed. Thereby, it is possible to precisely convey the recording sheet in the recording area, and to assure a predetermined tension to the recording sheet during conveyance so that a wide range of the recording sheet can be maintained in a flat state in the recording area.

FIG. 12A and FIG. 12B depict views for showing a positional relationship between the conveyance roller 36 and the pinch roller 37 that convey the recording sheet. As shown in FIG. 12B, the conveyance roller 36 has a length corresponding to the width of the recording sheet which is conveyed. On the other hand, the pinch roller 37 is provided with a plurality of rollers of short length, which are freely rotatable with respect to a shaft 371.

In this configuration, when the trailing edge of the recording sheet is released from its holding position by the conveyance roller 36 and the pinch roller 37, the pinch roller 37 is moved to the side of the conveyance roller 36 by a distance equivalent to the thickness of the recording sheet held by the pinch roller 37 at that time. The recording sheet is pushed by the urging force of the pinch roller 37, so as to be excessively conveyed. In this way, when the recording sheet is released from its holding position by the pinch roller 37, it is always conveyed by an amount which is larger than a predetermined amount. In accordance with this excessive conveyance, the conveyance roller 36 is forced to also be rotated by an amount corresponding to the excessive conveyance. This causes a conveyance error of the recording sheet consequently and shifting the dot positions in a recorded image. This results in image quality deterioration.

In order to cope with the above described conveyance error, one could envision, for example, that a brake could suppress the excessive conveyance rotation of the conveyance roller 36 when the recording sheet is released from the nip. However, this configuration causes a raise in the driving motor grade to compensate for the effect that load increase in torque load to drive the actual conveyance roller.

In order to solve the above described problems, there is disclosed a technique in which the nip position, when the trailing edge of the recording sheet passes the roller pair, is obtained on the basis of a change in the rotation state of rollers before and after the trailing edge of the recording sheet passes the roller pair, and in which the image is corrected on the basis of the nip position information (Japanese Patent Laid-Open No. 2002-254736).

However, in the above described prior art, it may be difficult to accurately detect the nip position, in the case where the rotation of the conveyance roller is not kept constant. Hence, it becomes necessary to accurately detect the nip position in order to steadily provide a high quality image. Further, a simple method could make it possible to accurately detect the passage of the trailing edge of the recording sheet through the nip position and to thereby eliminate the conveyance error of the recording sheet, as a result of which the image quality could remain high.

SUMMARY OF THE INVENTION

An object of the present invention is to solve the above described disadvantages of the prior art.

According to the present invention, a recording apparatus and a control method thereof are provided to control the conveyance of a recording sheet and the image recording, by correcting the conveyance error of the recording sheet caused in accordance to the passage of the recording sheet through a nip position of a roller pair.

Also, according to the present invention, a recording apparatus and a control method thereof are provided, where conveyance information from the detection of the recording sheet to the passage of the recording sheet through the nip, is stored in a memory, and where a point in time when the recording sheet passes the nip is evaluated in accordance with the conveyance information, as a result of which the point in time when the recording sheet passes the nip, can be always accurately evaluated without being influenced by variations in a mechanism.

According to an aspect of the present invention, there is provided with a recording apparatus for recording an image on a recording sheet held between rollers and conveyed by the rollers, comprising:

a recording head having a plurality of recording elements arranged in the conveyance direction of the recording sheet;

a first pair of rollers configured to hold and convey the recording sheet on the upstream side of a recording position in the conveyance path of the recording sheet;

a conveyance roller constituting a part of the first pair of rollers, configured to convey the recording sheet;

roller driving means for rotating the conveyance roller;

electric power detection means for detecting a variance of an electric power for driving the roller driving means, when the trailing edge of the recording sheet is released from a nip of the first pair of rollers; and head driving means for driving the recording head, to shift the recording elements of the recording head which are to be used, to the downstream side, when the electric power detection means detects the variance of the electric power.

According to an aspect of the present invention, there is provided with a control method of a recording apparatus for holding and conveying a recording sheet, and for performing recording by a recording head having a plurality of recording elements arranged in the conveyance direction of the recording sheet, the control method comprising:

a conveyance control step for conveying and driving the recording sheet by increasing a conveyance amount of the recording sheet by a predetermined amount, when the trailing edge of the recording sheet is released from a nip of a first pair of rollers which hold and convey the recording sheet on the upstream side of a recording position in the conveyance path of the recording sheet;

electric power detection step of detecting a variance of an electric power for driving the first pair of rollers, when the trailing edge of the recording sheet is released from a nip of the first pair of rollers; and head driving step of driving the recording head, to shift the recording elements of the recording head which are to be used, to the downstream side, when in the electric power detection step, the variance of the electric power is detected.

Other features, objects and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
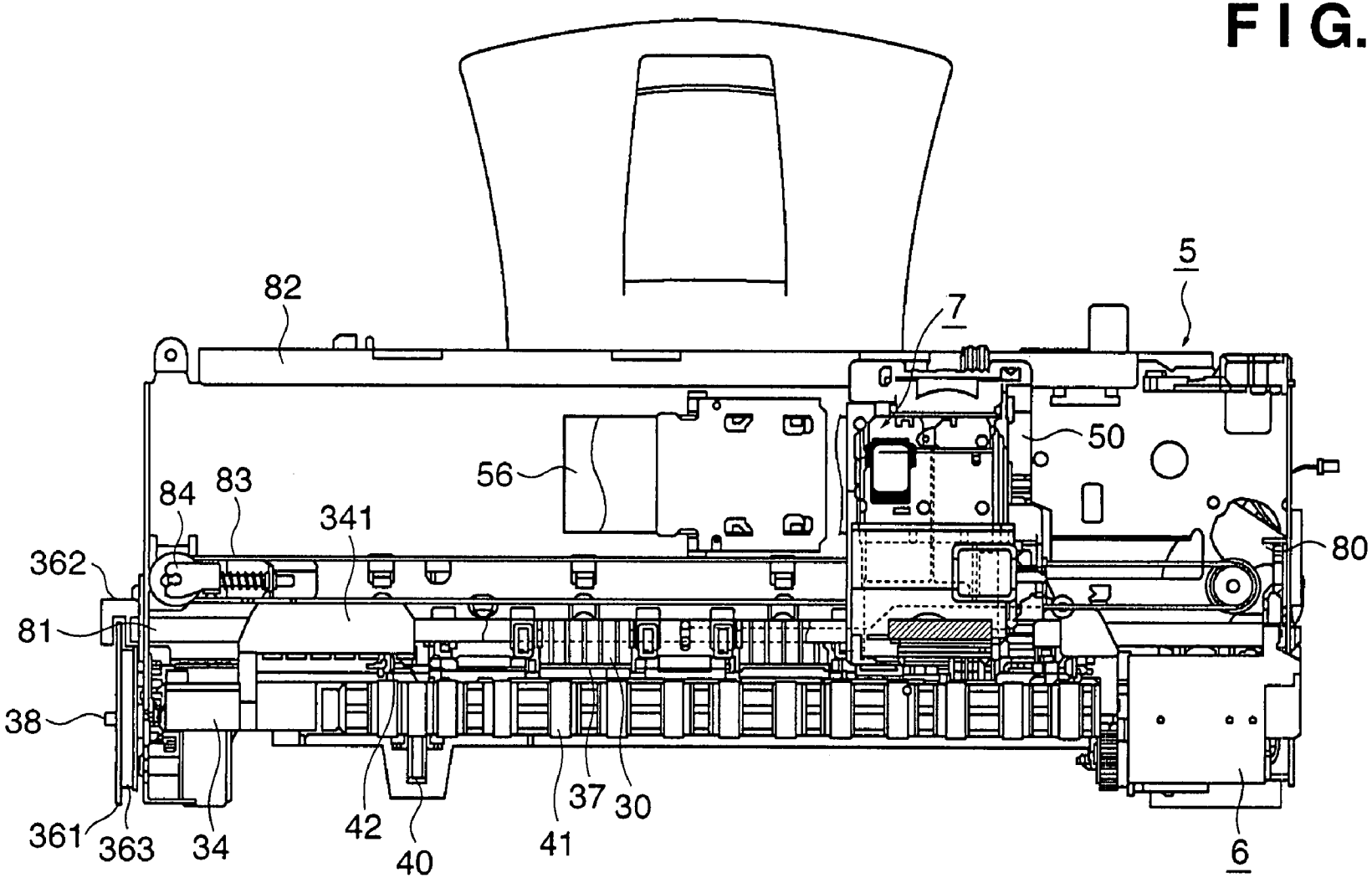
FIG. 1 depicts a top view explaining a mechanism section of a recording apparatus (ink-jet printer) according to a present embodiment.

In the following, preferred embodiments according to the present invention will be described with reference to the accompanying drawings. Noted that the following embodiments are not restrictive as to the scope of the present invention as recited in the claims, and all combinations of the features described in the embodiments are not always essential for the solution according to the present invention.

The recording apparatus according to the present embodiment relates for example to an ink-jet printer apparatus, to which an auto-document feeder (ADF) is mounted. The printer mounted with the auto-document feeder has a mechanism section consisting of a paper supply unit, a paper feeder, a paper discharge unit, a carriage unit, and a cleaning unit. In addition to the mechanism section, the printer is also provided with a controller (denoted by reference numeral 100 in FIG. 7) in the form of a circuit board, which performs control of each mechanism section as will be described below, and which performs printing operations based on print data. The controller 100 also comprises a CPU, a ROM, a RAM and the like. However, the present invention is not limited to the printer according to the above described embodiment, and the present invention is of course applicable to a printer of any printing system, provided that the printer comprises the mechanism for conveying a recording sheet, according to the present embodiment.

Figure 2:
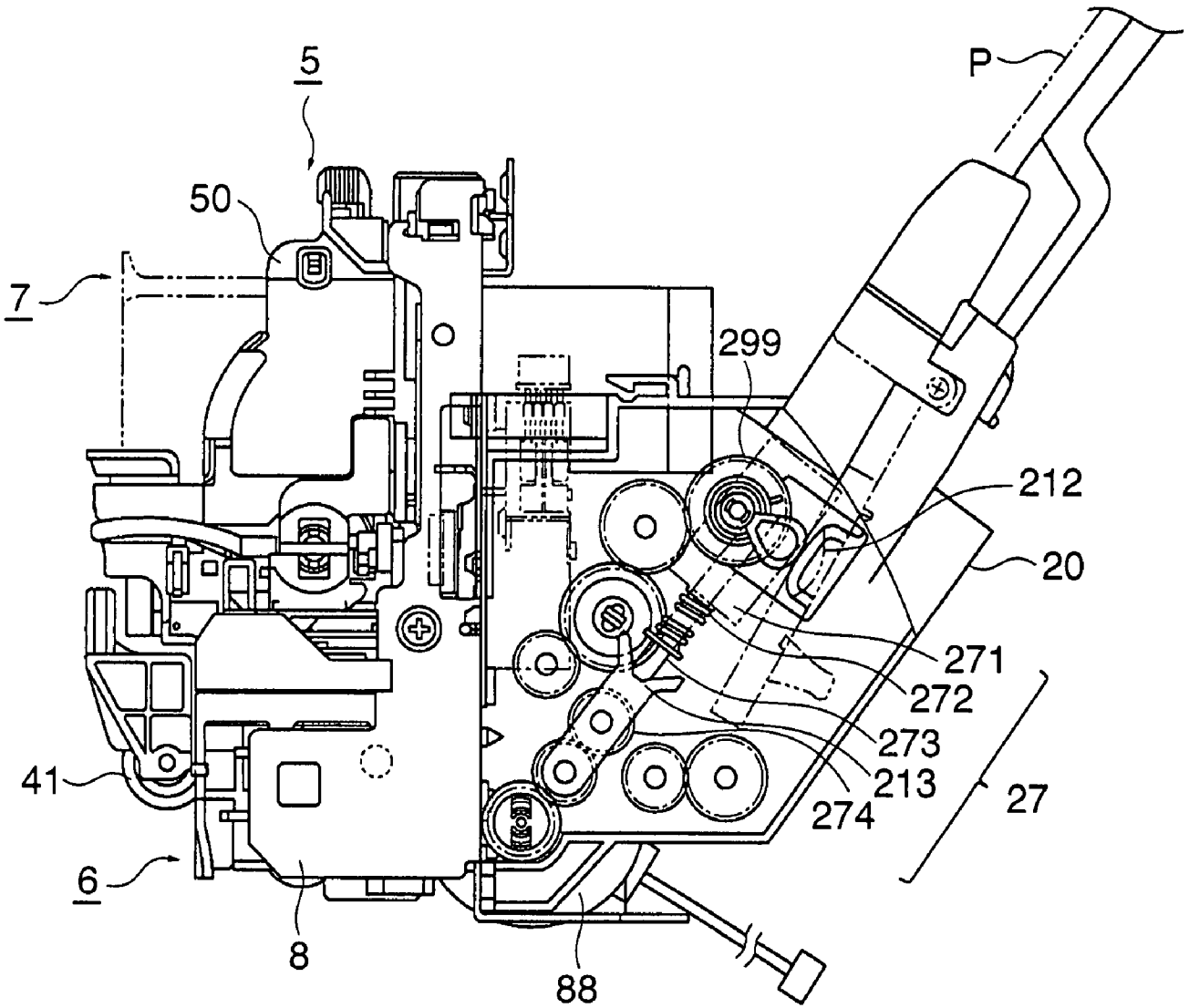
FIG. 2 depicts a side view of the mechanism section of the printer according to the present embodiment.
Figure 3:
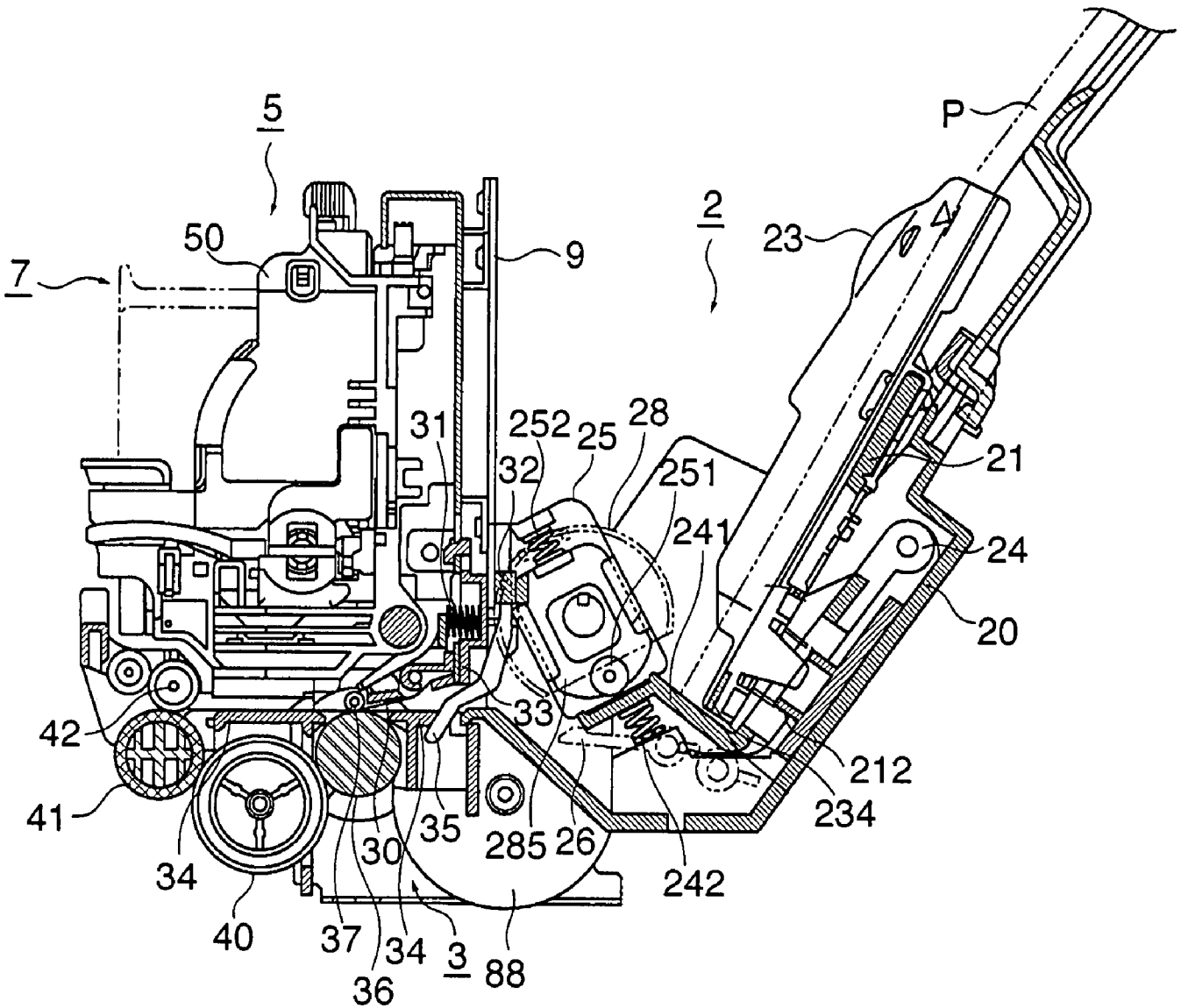
FIG. 3 depicts a cross-sectional side view of the mechanism section of the printer according to the present embodiment.

FIG. 1 depicts a top view explaining a mechanism section of a recording apparatus (ink-jet printer) according to the present embodiment, FIG. 2 depicts a side view of the mechanism section, and FIG. 3 depicts a cross-sectional side view of the mechanism section.

(A) Paper Supplier (Paper Supply Unit)

In FIG. 3, a paper supplier 2 is constituted by making the auto-document feeder mounted to a printer main body. The auto-document feeder has a base 20, a pressing plate 21 for loading recording sheets P and a feed roller 28 for feeding the recording sheet P. The feed roller 28 has a D-shaped section formed by cutting a part of a circle. The pressing plate 21 is provided with a movable side guide 23, which regulates the stacking position of the recording sheets P. The pressing plate 21 is provided rotatably about an rotating shaft provided in the base 20, and presses the stacked recording sheets P to the feed roller 28 by a pressing force of a pressing plate spring 212. For portions of the pressing plate 21 and the movable side guide 23, which portions face the feed roller 28, there are provided separation pads 213 (FIG. 2), 234 formed of a material having a large friction coefficient, such as artificial leather, in order to prevent double feed of the recording sheets P, respectively.

Further, a separation pad holder 24 provided with a separation pad 241 for separating the recording sheets P one by one, is rotatably mounted to the base 20 about an rotating shaft provided in the base 20, and is pressed towards the feed roller 28 by a separation pad spring 242. Further, a rolling roller holder 25 to which a rolling roller 251 is attached, is pressed to the separation pad holder 24 in the direction opposite to the above described pressing direction, at a predetermined pressure by a pressing force of a rolling roller spring 252.

The auto-document feeder is provided with a release cam gear 299 (FIG. 2) for releasing the abutment of the pressing plate 21 (or the recording sheet P loaded into the auto-document feeder) with the feed roller 28. The rotation amount of the gear 299 is set so that a cut portion 285 of the feed roller 28 comes to a position at which the cut portion faces the separation pad 241, when the pressing plate 21 is lowered to a predetermined position. Thereby, a predetermined space can be formed between the separation pad 241 and the feed roller 28. At this time, the rolling roller 251 abuts the separation pad 241 so as to prevent double feed of the recording sheets P.

As described above, in a standby state, the pressing plate 21 is pushed down by the release cam gear 299 to the predetermined position, thereby releasing the abutment of the pressing plate 21 with the feed roller 28, and the abutment of the separation pad 241 with the feed roller 28. In this state, when a driving force for driving the conveyance roller 36 of a paper feeder 3 as will be described below, is transmitted to the feed roller 28 and the release cam 299 via a gear and the like, the release cam 299 is separated from the pressing plate 21. Thereby, the pressing plate 21 is raised to make the feed roller 28 abut the recording sheet P, so that the recording sheet P is taken up in accordance with rotation of the feed roller 28, and separated one by one by the separation pad 241 so as to be conveyed to the paper feeder 3. When the recording sheet P has been conveyed into the paper feeder 3, the abutment of the feed roller 28 with the pressing plate 21, and the abutment of the feed roller 28 with the separation pad 241 are released by the release cam gear 299. When recording and discharge of the recording sheet P are completed, a return lever 26 acts on the recording sheet P which has entered on the separation pad 241, thereby enabling the recording sheet P to be returned to the loading position on the pressing plate 21.

When driving the return lever 26 and the feed roller 28, the driving force of the conveyance roller 36 is transmitted via predetermined gears. Switching of the transmission of the driving force is performed by a solenoid 271, a solenoid spring 272, a solenoid pin 273, and a planet gear arm 274 of a drive switching section 27 (FIG. 2). That is, when the solenoid pin 273 acts on the planet gear arm 274 to regulate the movement of the planet gear arm 274, the driving force of the conveyance roller 36 is not transmitted. On the other hand, when the solenoid pin 273 is separated from the planet gear arm 274, the planet gear arm 274 is made to be free, so that the driving force is transmitted to the return lever 26 and the feed roller 28 in accordance with normal or reverse rotation of the conveyance roller 36.

(B) Paper Feeder 3

Each element constituting the paper feeder 3 is attached to a chassis 8 (FIG. 2) which constitutes a structural member of the printer main body and which is made of a bent and raised sheet metal. That is, in order to convey the recording sheet P, the paper feeder 3 is constituted by comprising a pair of the conveyance roller 36 and the pinch roller 37 which are provided on the upstream side in the conveying direction with respect to an area printed by a print head 7, and a pair of a discharge roller 41 and a spur 42 which are provided on the downstream side. The conveyance roller 36 is formed by a metal shaft, the surface of which is coated with particles of ceramic and the like, and both ends of which are supported by two bearings 38 (see FIG. 1, the other not shown) provided on both side portions of the chassis 8.

A plurality of driven pinch rollers 37 are provided for the conveyance roller 36 so as to be able to abut the conveyance roller 36, and are held by a pinch roller holder 30. The pinch roller holder 30 is pressed by a pinch roller spring 31, so that the pinch roller 37 contacts the conveyance roller 36 and thereby produces a conveying force of the recording sheet P. At this time, the rotating shaft of the pinch roller holder 30 is attached to a bearing of an upper guide 33 provided with the chassis 8, so that the pinch roller holder 30 rotates about this shaft. The pinch roller holder 30 is integrally formed so as to have the rigidity not less than certain level in the conveyance direction of the recording sheet P. The rigidity of the pinch roller holder 30 in the direction perpendicular to the conveyance direction is set to be relatively low, so as to make the pressing force of the pinch roller spring 31 suitably act on the pinch roller 37. As described above, all the pinch rollers 37 are also arranged in substantially parallel with the rotating shaft of the conveyance roller 36. The pinch roller holder 30 and the upper guide 33 also serve as a guide of the recording sheet P. A platen 34 for guiding the recording sheet P is arranged at the entrance of the paper feeder 3 to which the recording sheet P is conveyed from the above described paper supplier 2. Further, there is provided on the upper guide 33 a PE sensor lever 35 for actuating a PE sensor 32 for detecting the leading edge and the trailing edge of the recording sheet P. Further, the platen 34 is attached to the chassis 8 so as to be positioned. The pinch roller 37 according to the present embodiment is formed by a resin with excellent smoothing characteristics such as POM, and the outer diameter of the pinch roller 37 is set to about $\phi$3 to 7 mm.

Further, on the side of the platen 34, which provides a reference surface to the recording sheet P, there is provided a paper sheet presser (not shown) covering the end of the recording sheet P. This makes it possible to prevent the recording sheet P from being lifted up at its end and interfering with a carriage 50 or the print head 7, even when the end of the recording sheet P is deformed or curled.

In the upper part of the above described paper feeder 2, a carriage unit 5 as will be described below is constituted, to which carriage unit 5 the print head 7 is mounted. In accordance with a scanning operation of the carriage unit 5, recording is performed by ejecting ink from the print head 7 to the recording sheet P conveyed by a pair of the conveyance roller 36 and the pinch roller 37, and by a pair of the discharge roller 41 and the spur 42. During the printing operation, the recording sheet P sent to the paper feeder 3 is guided to the platen 34, the pinch roller holder 30 and the upper guide 33, and is then sent to the roller pair of the conveyance roller 36 and the pinch roller 37. At this time, the PE sensor lever 35 is operated by the leading edge of the conveyed recording sheet P, so that the leading edge of the recording sheet P is detected by the PE sensor 32. Thus, the printing position to the recording sheet P can be defined on the basis of this detection result. Further, the recording sheet P is conveyed on the platen 34 with the conveyance roller pair 36, 37 rotated by rotational drive of a LF motor 88. An encoder wheel 361 (FIG. 1) for detecting the rotational position of the conveyance roller 36 is attached to the conveyance roller 36. The encoder wheel 361 is a disk-shaped transparent sheet on which marks are radially formed at a predetermined constant pitch. The rotational position or rotation amount of the conveyance roller 36 can be obtained by detecting the marks with the use of an optical encoder sensor 362 (FIG. 1) fixed to the chassis 8.

Noted that in the carriage unit 5, as described above, the print head 7 and ink tanks for supplying black and color inks to the print head 7 are attached separately for each color of ink and in an attachable/detachable manner to/from the carriage unit 5. This print head 7 is a type in which heat is imparted to the ink by a heater so as to cause film boiling of the ink. Thus, pressure variations are generated by growth and contraction of air bubbles produced by the film boiling, whereby the ink is ejected from the nozzle of the print head 7 so as to enable an image to be printed on the recording sheet P. However, the present invention is not limited to such type of ink-jet printer. In the print head 7 for each color ink, the above described nozzles constituting recording elements are arranged in parallel so as to be along with the conveyance direction of the recording sheet, thereby making it possible to perform the setting of unused nozzles and correction in accordance with conveyance errors of the recording sheet, as will be described below with reference to FIG. 6A to FIG. 6C.

(C) Carriage Unit 5

The carriage unit 5 has the carriage 50 to which the print head 7 is attached. The carriage 50 is supported by a guide shaft 81 (FIG. 1) extending in the direction perpendicular to the conveyance direction of the recording sheet P, and by a guide rail 82 (FIG. 1) extending in the same direction as the guide shaft and holding the rear end of the carriage 50 for maintaining a gap between the print head 7 and the recording sheet P.

Further, the carriage 50 is driven by a carriage motor 80 (FIG. 1) attached to the chassis 8 via a timing belt 83 (FIG. 1). The timing belt 83 is stretched and supported by an idle pulley 84 (FIG. 1). Further, the carriage 50 comprises a flexible circuit board 56 (FIG. 1) for transmitting a recording signal and the like from an electric circuit board 9 (FIG. 3) constituting the above described controller 100 (FIG. 7) to the print head 7.

In the above configuration, when a printing operation on the recording sheet P is performed, the recording sheet P is conveyed by the roller pair 36, 37 to a row position (position in the conveyance direction of the recording sheet P) for printing, and the carriage 50 is moved to a column position (position in the direction perpendicular to the conveyance direction of the recording sheet P) for printing by rotation of the carriage motor 80, so that a scanning operation of the print head 7 is performed. During the scanning operation, the print head 7 is driven on the basis of print data from the controller 100 to make ink ejected to the recording sheet P, as a result of which an image and the like can be printed.

(D) Paper Discharge Unit

A pair of the discharge roller 41 and the spur 42 of the above described paper feeder 3 constitutes the paper discharge unit. That is, the spur 42 is rotatably provided for a spur base 341 (FIG. 1) so as to correspond to the discharge roller 41, and is made to abut the discharge roller 41. Rotation of the discharge roller 41 is activated by making the rotational driving force of the LF motor 88 for the conveyance roller 36 transmitted by a transfer gear 40.

The discharge roller 41 is constituted by providing a plurality of roller units formed by high friction material such as rubber, for a shaft made of a metal or a resin (see FIG. 1). Further, the spur 42 having a thickness of about 0.1 mm, is provided with protrusions around its outer circumference, and is constituted by a metal plate made of SUS (stainless steel) or the like, and by a resin section consisting of POM and constituting a rotary bearing.

The transfer roller 40 transmitting the rotation of the discharge roller 41 is constituted by attaching a low hardness and high friction material such as a styrene-based elastomer, to the outer circumference of a disc-shaped roller such as POM. The transfer roller 40 is made to abut both the conveyance roller 36 and the discharge roller 41 with a predetermined pressure, thereby enabling the driving force to be transmitted.

In the above described configuration, the recording sheet P on which a printing operation has been performed by scanning the print head 7 of the carriage unit 5, is held by the nip of the discharge roller 41 and the spur 42 so as to be conveyed, and then discharged to a discharge tray and the like. During the conveyance of the recording sheet P, after the trailing edge of the recording sheet P is released from the conveyance roller 36 and the pinch roller 37, the recording sheet P is held by the discharge roller 41 and the spur 42 so as to be conveyed, and is printed or discharged. Further, the spur 42 is constituted so that a spur cleaner abuts the spur 42 to thereby remove the ink and the like attached to the spur 42.

(E) Cleaning Unit 6

A cleaning unit 6 (FIG. 1, FIG. 2) is constituted by comprising a pump (not shown) for performing an ejection recovery operation of the print head 7, and a cap (not shown) for preventing ink in each nozzle of the print head 7 from being dried.

Figure 4:
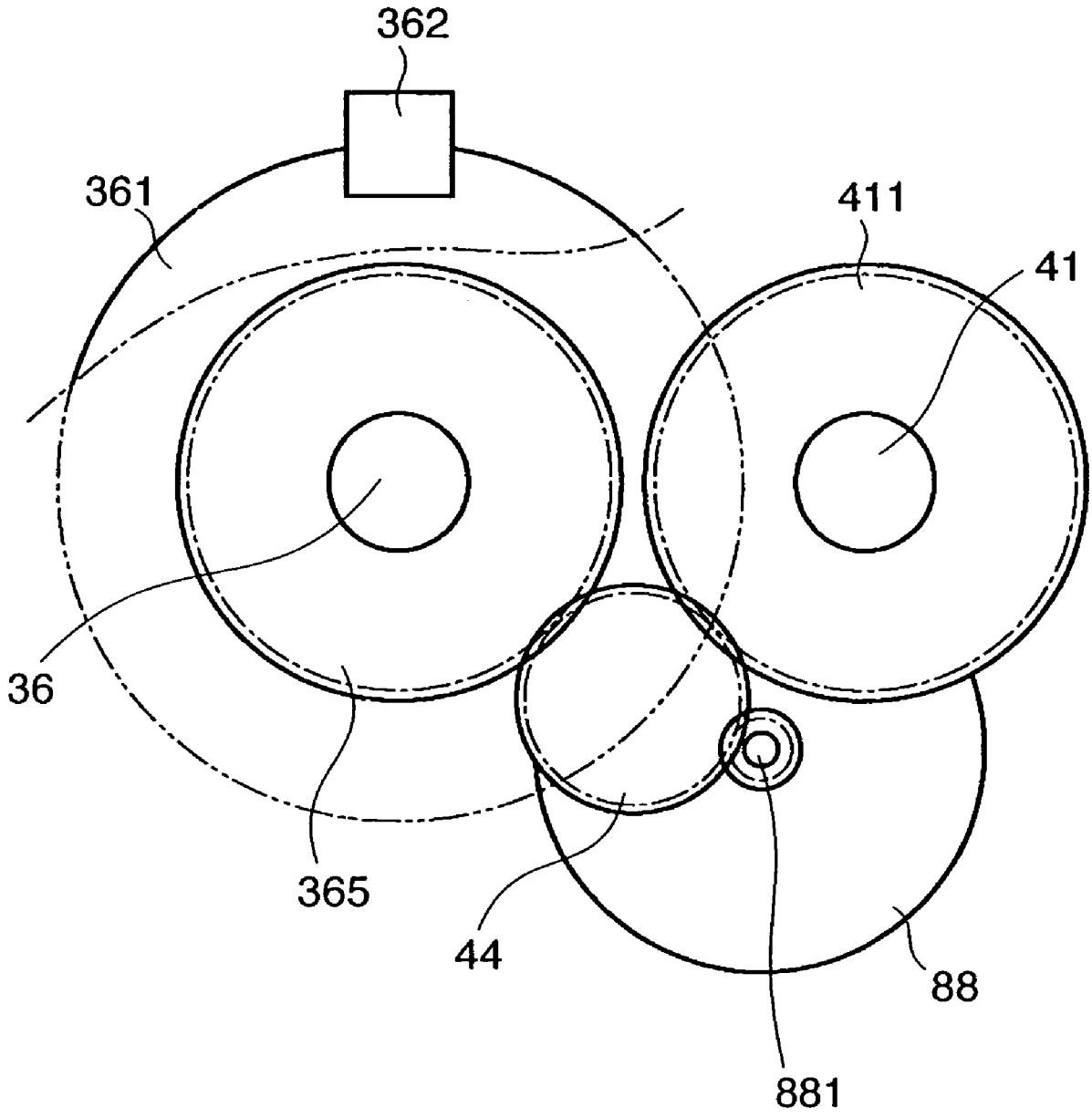
FIG. 4 depicts a view explaining details of a detection mechanism for detecting a rotational position or a rotation amount of a conveyance roller of the printer according to the present embodiment.

FIG. 4 depicts a view explaining details of a detection mechanism for detecting the rotational position or the rotation amount of the conveyance roller 36 of the printer according to the present embodiment.

As described above, the encoder wheel 361 is attached to the rotating shaft of the conveyance roller 36. Specifically, the rotating shaft of the conveyance roller 36 is pressed into the encoder wheel 361, thereby enabling the center of rotation of the encoder wheel 361 to be defined. Further, the encoder wheel 361 is bonded to a LF pulley 363 (FIG. 1), so that the mechanical strength of the encoder wheel 361 is increased. As shown in the figure, the encoder wheel 361 is in the form of a disk-shaped transparent seat, on which marks are radially formed with a constant pitch. The fixed optical encoder sensor 362 is provided to correspond to the encoder wheel 361. The marks formed on the encoder wheel 361 are detected by the encoder sensor 362, so that it is possible to obtain the rotational position and the rotation amount of the conveyance roller 36. That is, in accordance with the rotation of the conveyance roller 36, a detection signal is generated each time a mark on the encoder wheel 361 reaches the position of the encoder sensor 362, and is sent to the above described controller 100. In the controller 100, the rotational position and the rotation amount of the conveyance roller 36 can be obtained by counting the number of the detection signals from a predetermined reference rotational position.

The driving of the conveyance roller 36 can be effected by making the driving force of the LF motor 88 transmitted via a gear train, as shown in FIG. 4. That is, as shown in FIG. 4, a LF gear 365 is attached to the conveyance roller 36, and a discharge roller gear 411 is attached to the discharge roller 41. Both the LF gear 365 and the discharge roller gear 411 engage a paper discharge idler gear 44. Further, a LF motor gear 881 fixed to the rotating shaft of the LF motor 88 engages the paper discharge idler gear 44. Thereby, it is possible to reduce the backlash of the gear train from the LF motor gear 881 through the paper discharge idler gear 44, to the LF gear 365 and the discharge roller gear 411. As a result, the relationship between the rotational positions of the conveyance roller 36 and the discharge roller 41 can be held with comparatively high accuracy.

Next, image position correction in a printing operation in the printer according to the present embodiment as described above, is specifically explained with reference to FIG. 5 and FIG. 6A to 6C.

Figure 5:
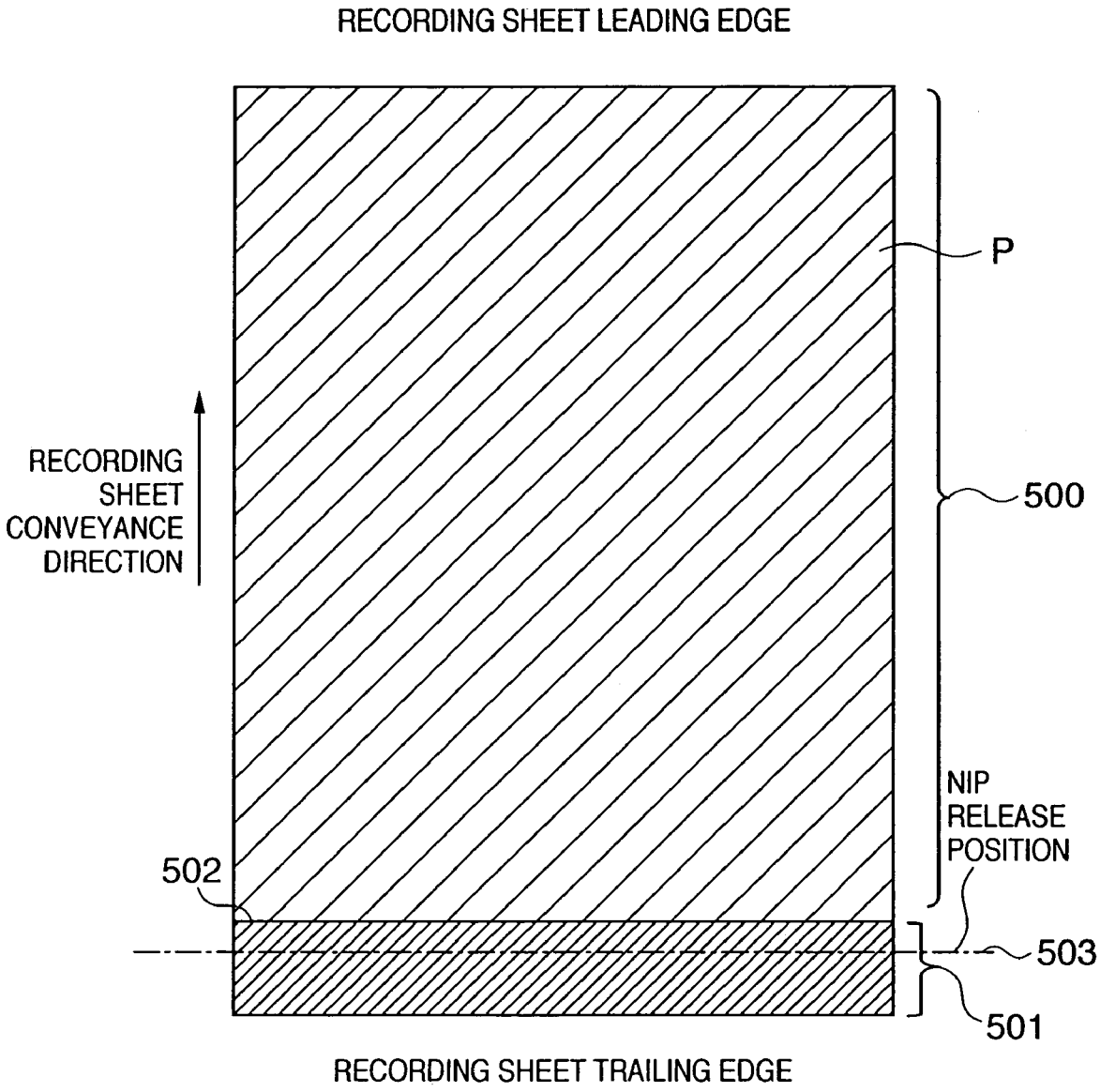
FIG. 5 is a conceptual diagram explaining printing control in the printer according to the present embodiment.
Figure 6A:
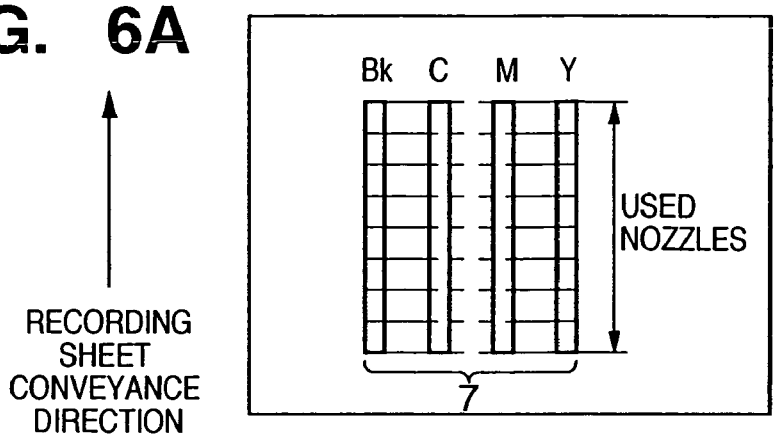
FIGS. 6A to 6C depict views for explaining printing control for each printing area in the printer according to the present embodiment.
Figure 6B:
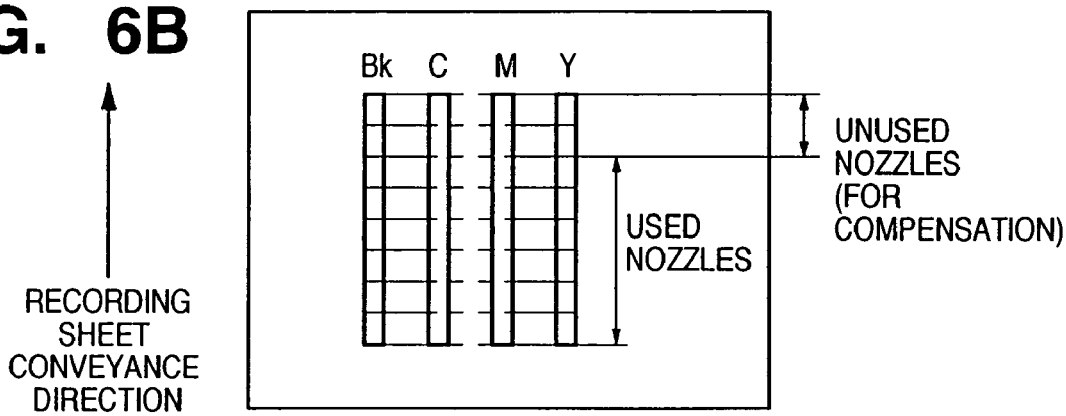
Figure 6C:
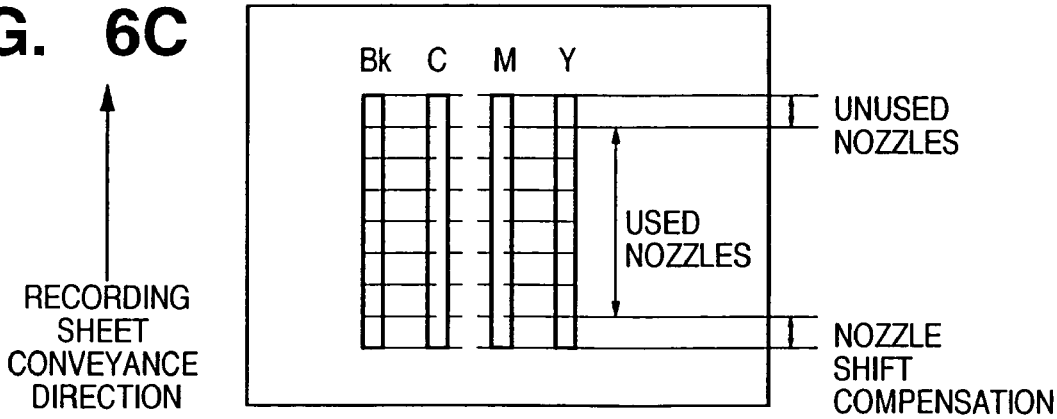

FIG. 5 depicts a conceptual diagram explaining the printing control in the printer according to the present embodiment. The figure shows an example of a case where the printing control is made different in accordance with the printing area of the recording sheet P. FIG. 6A to FIG. 6C respectively depict views explaining a range of used nozzles (used part) in the print head 7 for each printing control as described above.

The present embodiment is explained by a case where a printing area printed by scanning the print head 7 is printed by a so-called multi-pass printing in which the printing area is printed by a plurality of times of scanning and in which nozzles used for printing in each scanning are different from each other. In the multi-pass printing according to the present embodiment, as shown in FIG. 5, the printing control is performed by dividing the printing area into an area 500 (four pass area) where printing is completed by four times of scanning of the print head, and an area 501 (six pass area) where printing is completed by six times of scanning of the print head. That is, in the four pass area 500, four nozzle groups (⅔ of each all nozzles) obtained by dividing all nozzles of each color head of the print head 7 into four are used, and the four pass printing as shown in FIG. 6A is performed on respectively corresponding areas. In the six pass area 501, six nozzle groups (⅛ of each all nozzles) obtained by dividing ⅝ of all nozzles of each color head of the print head 7 into six are used, and the printing operation is switched to the six pass printing as fundamentally shown in FIG. 6B and performed.

In the conveyance of the recording sheet P, the recording sheet P is released in its trailing edge from the holding part (nip) of the conveyance roller 36 and the pinch roller 37 on the upstream side, and is conveyed only by the discharge roller 41 and the spur 42 on the downstream side. In the case of such conveyance only by a single roller pair, the conveyance accuracy deteriorates in comparison with the case where the recording sheet is held and conveyed by two roller pairs including a roller pair 36, 37 on the upstream side and a roller pair 41, 42 on the downstream side. For this reason, the conveyance error is reduced by making the amount of conveyance for a single conveyance operation per one scanning of the print head small, while conveying by a single roller pair. In addition to this, the number of times (pass number) of scanning the printing area by the multi pass scanning is increased (4 to 6) in the area where the conveyance accuracy deteriorates, so that the irregularity of image density caused by the above described error is made inconspicuous. For this reason, in the present embodiment, as shown in FIG. 5, the six pass area 501 is provided to around the trailing edge of the recording sheet P, in which area the amount of conveyance of the recording sheet for each pass is made smaller than the amount in the four pass area 500, and the six pass printing with the larger number of pass than the four pass is performed.

In the conveyance of the recording sheet P according to the present embodiment, the above described pass switching is performed when the image forming position reaches a "path switching position" 502 shown in FIG. 5. At this time, the recording sheet P is still held by the pair of rollers 36, 37. However, unused nozzles for image correction are provided on the downstream side in the conveyance direction of the recording sheet P, so as to enable the image correction to be implemented at a "nip release position" 503 as will be described below, as a result of which it is necessary to perform the pass switching before the "nip release position" 503. Thus, as will be explained below, image data (print data) is corrected on the basis of the following nip position information pre-stored in storage means (EEPROM), and the printing after the nozzles are shifted as shown in FIG. 6C is performed in a subsequent printing process.

In the normal printing shown in FIG. 6A, all nozzles of each print head 7 of black (Bk), cyan (C), magenta (M) and yellow (Y) are used. Since the four pass printing is performed, the amount of a single conveyance of the recording sheet P per one scanning of the print head is set to ¼ (equal to ⅜ of all nozzles) of whole nozzle width (head length). In this way, printing of each printing area corresponding to the ¼ width of each print head is completed by performing each of four times of scanning of the print head 7. In accordance with the conveyance of the recording sheet P, the four pass printing is performed up to the above described "pass switching position" 502 of the recording sheet P, and the printing of the four pass area is completed. Then, a part of the nozzles of each print head 7 used in the final stage for completing the printing of the four pass area, is used for six pass area. At this time, however, nozzles to be used in the six pass area are shifted in correspondence with the amount of a single conveyance per one scanning of the print head, so as to prevent nozzles used for the four pass area 500 from being used in the six pass area 501, and the printing of the four pass area is first completed. The purpose of such control in the pass number switching is to simplify the program for performing the printing control. However, the processing for switching from the four pass to the six pass is, of course, not limited to the present embodiment.

In this way, when the printing of the four pass area 500 is completed, the printing after the pass switching shown in FIG. 6B, i.e., printing after being switched to the six pass printing is then performed. In this printing, as shown in FIG. 6B, a part of usable nozzles of the print head 7 (⅜ of all nozzles positioned on the upstream side in the conveyance direction of the recording sheet P in this embodiment) are set to be an unused part. In the present embodiment, ⅜ of all nozzles are set to be an unused part, and printing is performed by using the remaining ⅝ of all nozzles. Since the six pass printing is performed in this area, the printing width for each scanning of the print head is ⅛ of all nozzles, so that the amount of the conveyance of the recording sheet P per one scanning of the print head is set to ⅛ of the whole nozzle width (head length), as described above.

In this six pass printing area 501, when the trailing edge of the recording sheet P is released from the nip of the pair of conveyance roller 36 and 37, the recording sheet P is sent out by the pressing force of the pinch roller 37, so that the conveyance roller 36 and the discharge roller 41 may be rotated by the backlash set to the above described gear train (365, 411, 881). In this case, the position of image printed on the recording sheet P is significantly shifted to cause a problem that the quality of the printed image is impaired. For this reason, in the present embodiment, the printing operation immediately after the trailing edge of the recording sheet P is released from the nip of the rollers 36 and 37, is adjusted as will be described below, so that an image having high quality is printed.

Figure 7:
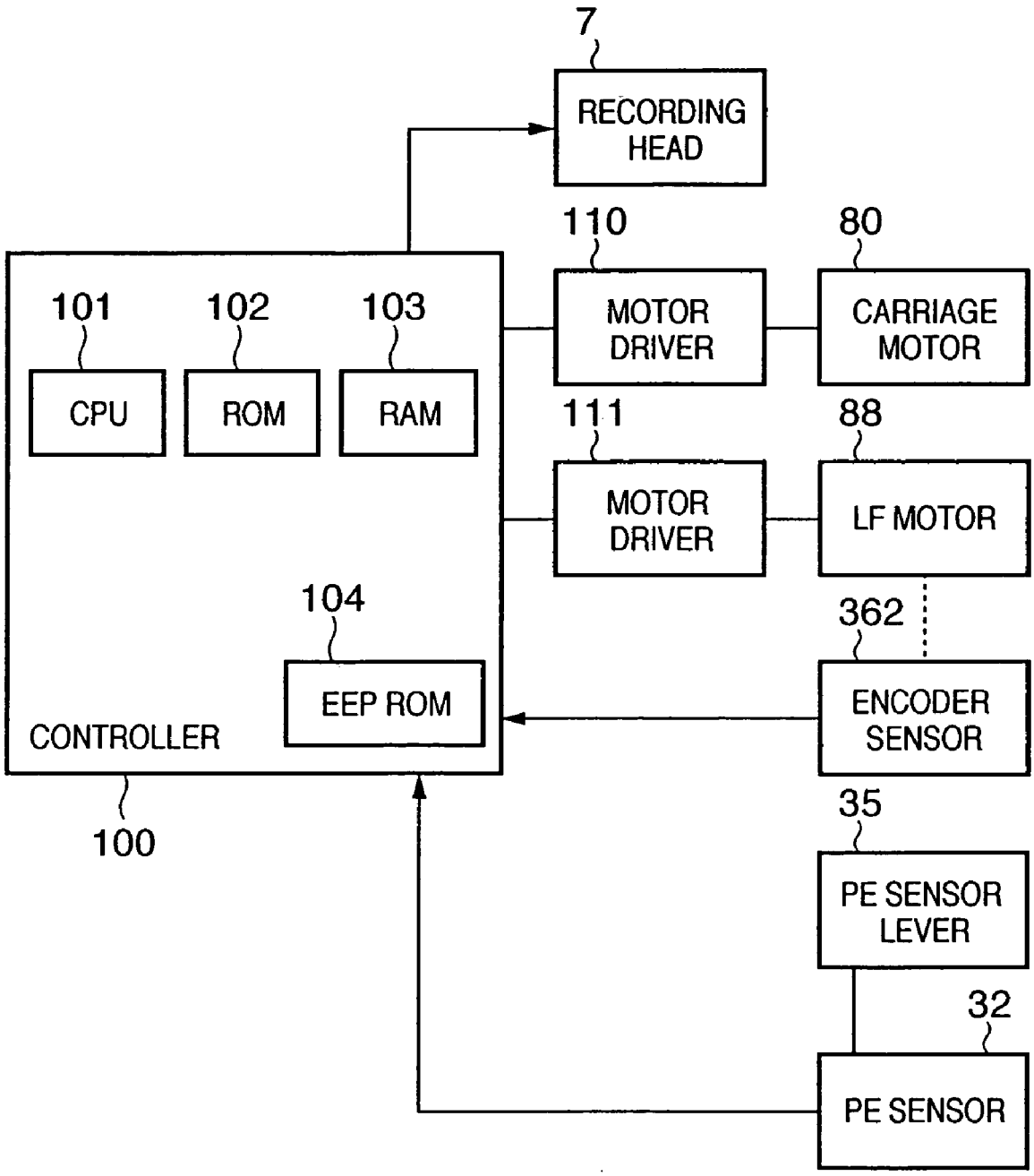
FIG. 7 is a block diagram explaining a control system of the printer according to the present embodiment.

FIG. 7 is a block diagram explaining a control system of the printer according to the present embodiment, and portions which are common to those in the above described figures are denoted by the same reference numerals.

In the figure, the controller 100 comprises a CPU 101, a ROM 102 storing a program of the CPU 101 and various data, and a RAM 103 used as a working area when the CPU 101 implements control operation in accordance with the program, and temporarily storing various data. An EEPROM 104 is a memory for storing in a nonvolatile state a count value of the number of pulses detected by the encoder sensor 362 during a period from the passage of the trailing edge of the recording sheet P through the PE sensor lever 35 to the passage of the trailing edge of the recording sheet P through the nip of the conveyance roller 36, as will be described below. Reference numerals 110, 111 denote motor drivers, each of which rotationally drives corresponding one of the carriage motor 80 and the LF motor 88 in accordance with an instruction from the controller 100.

Figure 8:
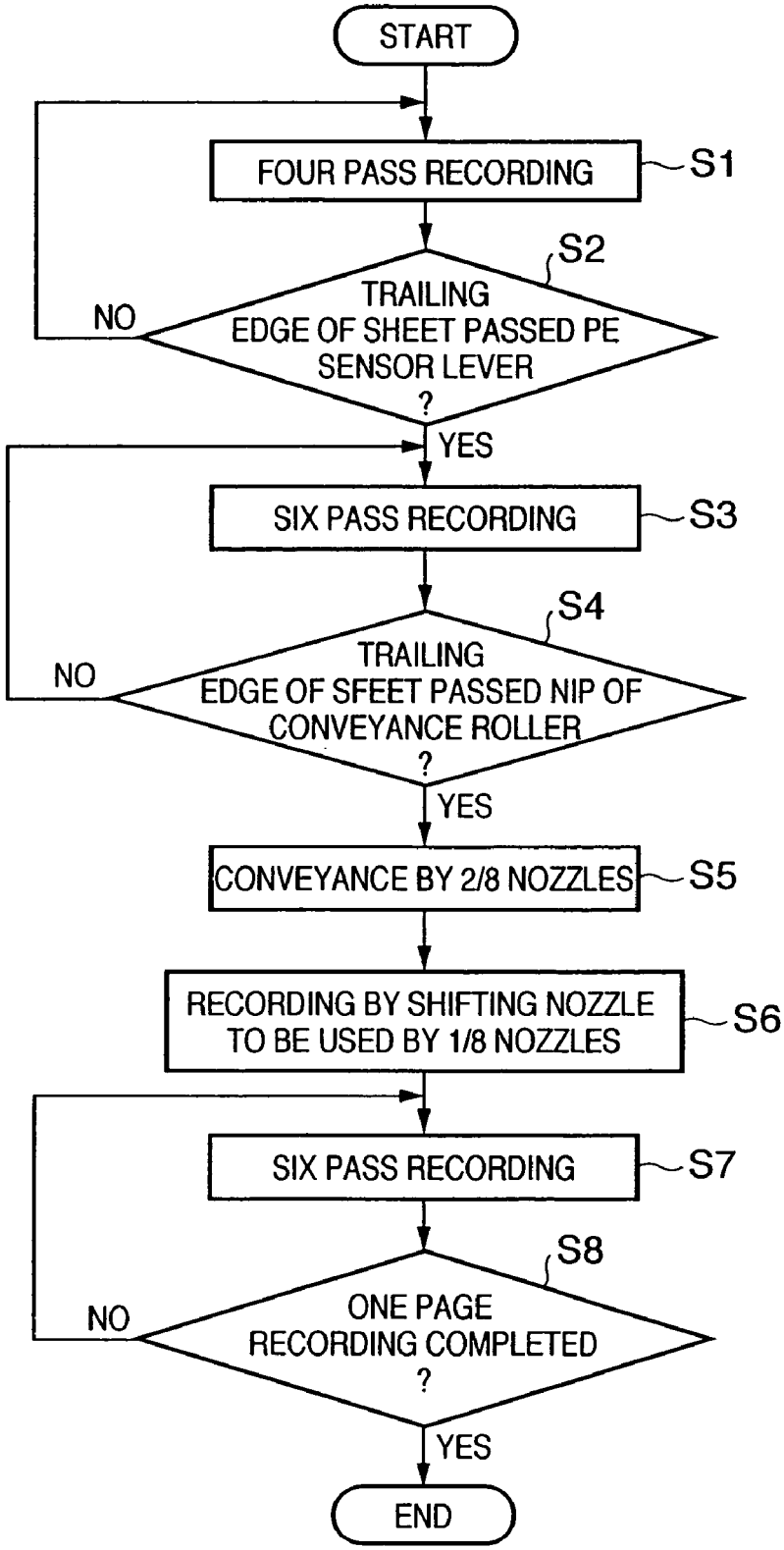
FIG. 8 is a flow chart explaining a printing operation in the printer according to the present embodiment.

FIG. 8 is a flow chart explaining the printing processing in the printer according to the present embodiment. The program for implementing the processing is stored in the ROM 102 and is executed under the control of the CPU 101.

First, in step S1, as shown in FIG. 6A, an image is printed by the multi pass printing of four pass. Then in step S2, the passage of the trailing edge of the recording sheet P through the PE sensor lever 35 is detected by the PE sensor 32. When the trailing edge of the recording sheet P passes the PE sensor lever 35, the process proceeds to step S3 so that the four pass printing performed up to that time is switched to the six pass printing. If nozzles corresponding to the part of the four pass printing of the print head 7 exist in the switching, the printing control for the nozzles is made to be different from that for nozzles corresponding to the area 501 to be newly printed by the six pass printing, but the explanation of the details of such printing control is omitted here.

In this way, during the six pass printing of an image, it is determined in step S4 whether the trailing edge part of the recording sheet P is released from the nip of the pair of rollers 36 and 37. Here, for example, the rotation amount of the conveyance roller 36 is judged by the signal from the encoder sensor 362, and then it is determined on the basis of the nip position information (described later) which is stored in advance in the EEPROM 104, whether the trailing edge of the recording sheet P is released from the nip of the pair of rollers 36 and 37. Next, when it is determined in step S4 that the trailing edge of the recording sheet P is released from the nip, the process proceeds to step S5. In the step S5, the amount of the conveyance of the recording sheet per one scanning of the print head immediately after that time is set to twice the amount of the conveyance (the conveyance amount of ⅛ of all nozzles) performed in the six pass printing up to that time, i.e., the conveyance amount of ⅜ of all nozzles (two-line feed) per one scanning of the print head. Next, in step S6, nozzles of the print head 7 which are to be used, are shifted to the downstream side in the conveyance direction by ⅛ of all nozzles, as shown in FIG. 6C, in accordance with the increase of the conveyance amount by ⅛ of all nozzles immediately after the trailing edge of the recording sheet P is released from the nip in step S5. As a result, immediately after the trailing edge of the recording sheet P is released from the nip of the conveyance roller 36 and the pinch roller 37, the position of dots ejected toward the recording sheet P is in the state of being shifted on the downstream side in the conveyance direction of the recording sheet P by ⅛ of all nozzles. This makes it possible to properly print an image on the recording sheet P without the positional shift of dots of the image, even when the recording sheet P is excessively conveyed immediately after it is released from the nip.

The reason for this processing is that it is impossible to accurately convey the recording sheet P by ⅛ of all nozzles immediately after the trailing edge of the recording sheet P is released from the nip. The reason for this inaccuracy in the conveyance is, as described above, that the recording sheet P is excessively conveyed by the pressing force of the pinch roller 37, by the amount of the backlash of the LF gear 365, the discharge roller gear 411, the discharge idler gear 44, and the LF motor gear 881 in addition to the conveyance amount of ⅛ of all nozzles, and hence, the accuracy of the stop position of the recording sheet P cannot be sufficiently secured.

Therefore, in the present embodiment, the conveyance operation of the recording sheet P by the conveyance amount of ⅜ of all nozzles, which amount is obtained by adding the amount of ⅛ of all nozzles to the conveyance amount of the recording sheet P by ⅛ of all nozzles, is performed so as to absorb the positional shift of the trailing edge of the recording sheet P due to the backlash of the above described gear train. In addition, the trailing edge of the recording sheet P is accurately positioned in the position of an integer multiple (here twice) of ⅛ of all nozzles away from the nip position, and the nozzle used for the printing at the position is shifted to the downstream side in the conveyance direction of the recording sheet P by the ⅛ of all nozzles. As a result, dots are formed at proper positions of the recording sheet P, thereby enabling the positional image shift to be prevented, and an image having high quality can be printed.

Noted that in the present embodiment, the above described backlash of the gear train is set so as to make the conveyance error generated by the backlash less than ⅛ of all nozzles, so that the conveyance error caused by the backlash as a whole can be absorbed by additionally performing the conveyance operation by the ⅛ of all nozzles.

After step S6 is executed in this way, the process proceeds to step S7, and the six pass printing is repeatedly implemented. When the image printing for one page is completed in step S8, this printing processing is ended.

In the above described correction operation, it is important to accurately determine whether the trailing edge of the recording sheet P is released from the nip. To this end, it is necessary to accurately specify the nip position in the conveyance path.

Figure 9:
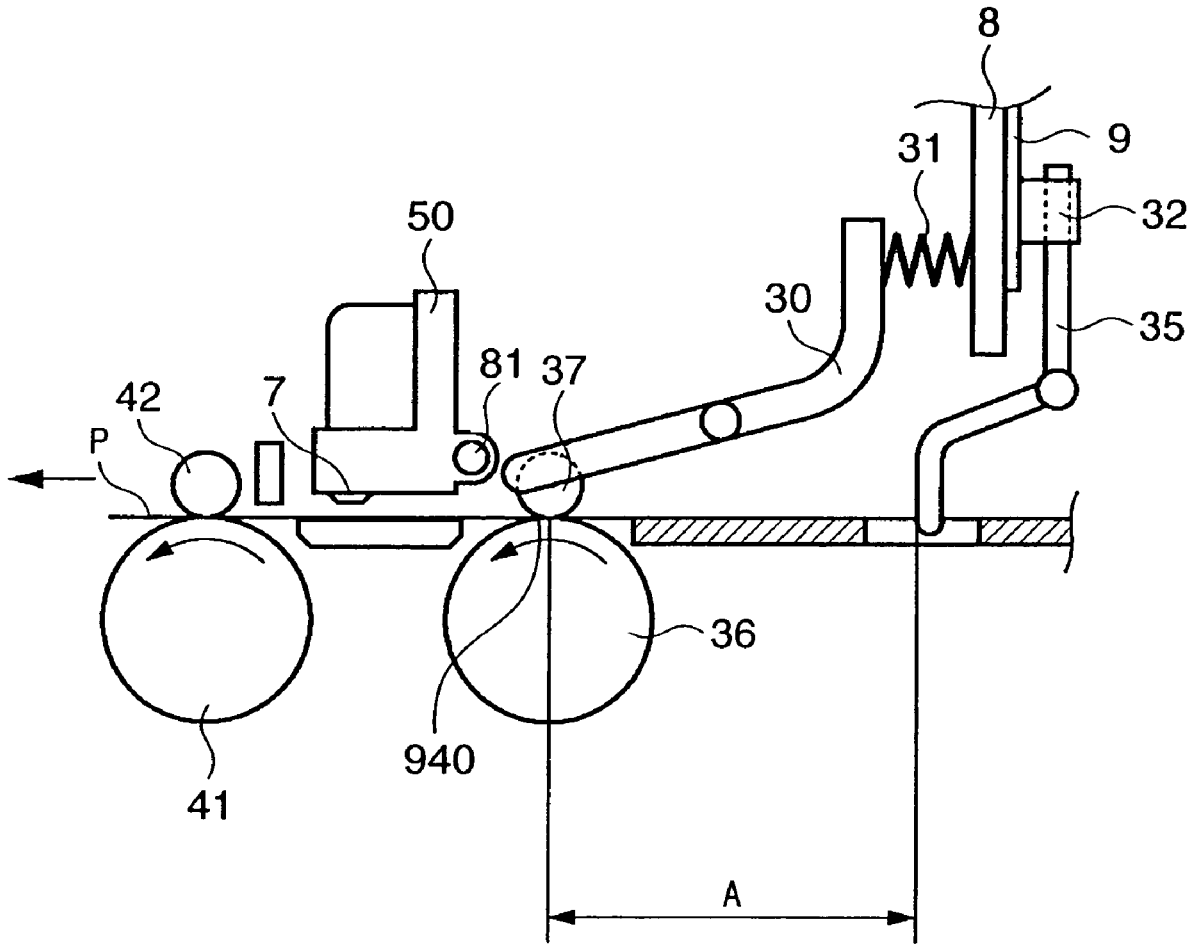
FIG. 9 depicts a view explaining an example for specifying a nip position in a conveyance path by using a position of a PE sensor lever as a reference position.

FIG. 9 depicts a view explaining an example for specifying the nip position in the conveyance path by using the position of the PE sensor lever 35 as a reference position, and portions which are common to those in FIG. 3 described above are denoted by the same reference numerals. Here, noted that the position of the nip 940 is specified by a distance A from the PE sensor lever 35 provided in the conveyance path at the upstream of the nip 940.

However, in practice, the distance between the PE sensor lever 35 and the nip 940 is not made constant for each printer, due to variations in components (parts) and the like. Accordingly, in the present embodiment, a recording sheet P is guided through the printer, and variations in the drive condition of the LF motor 88 are detected when the trailing edge of the recording sheet P is released from the nip 940 of the pair of rollers 36, 37. On the basis of the detection, operation procedures for obtaining the accurate position information on the nip 940 and for writing the obtained information into the EEPROM 104 are implemented.

Figure 10:
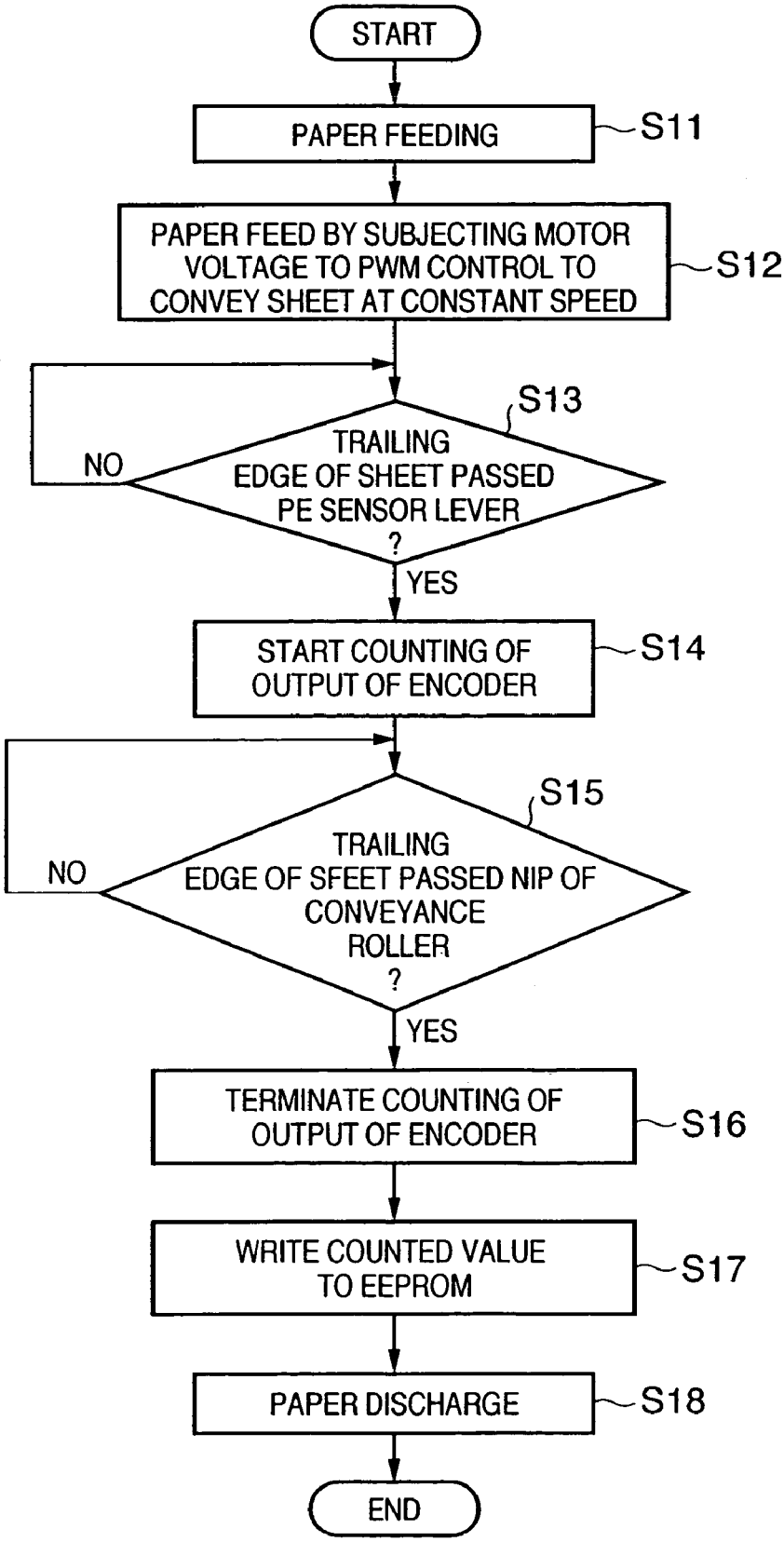
FIG. 10 is a flow chart explaining an operation for storing position information when the trailing edge of a recording sheet P passes the nip in the printer of the embodiment according to the present invention.

FIG. 10 is a flow chart explaining the processing for storing information (position information) of the position at which the trailing edge of the recording sheet P passes the nip in the printer of the embodiment according to the present invention. The program for performing this processing is stored in the ROM 102, and is executed under the control of the CPU 101.

First, in step S11, a paper feeding operation by an auto-document feeder, and a conveyance operation of the recording sheet P by the conveyance roller 36 and the discharge roller 41 are performed. In the conveyance of the recording sheet P by the conveyance roller 36, the PWM value of the motor driving voltage is controlled by the controller 100 so as to make the conveying speed of the recording sheet P constant (step S12). In this conveyance operation, in step S13, when the PE sensor 32 detects that the trailing edge of the recording sheet P passes the PE sensor lever 35, the process proceeds to step S14, and the detection signal is counted on the basis of the signal from the encoder sensor 362. The counted value is stored by the counter of the RAM 103. Next, in step S15, it is determined whether the trailing edge of the recording sheet P is released from the nip 940.

Figure 11:
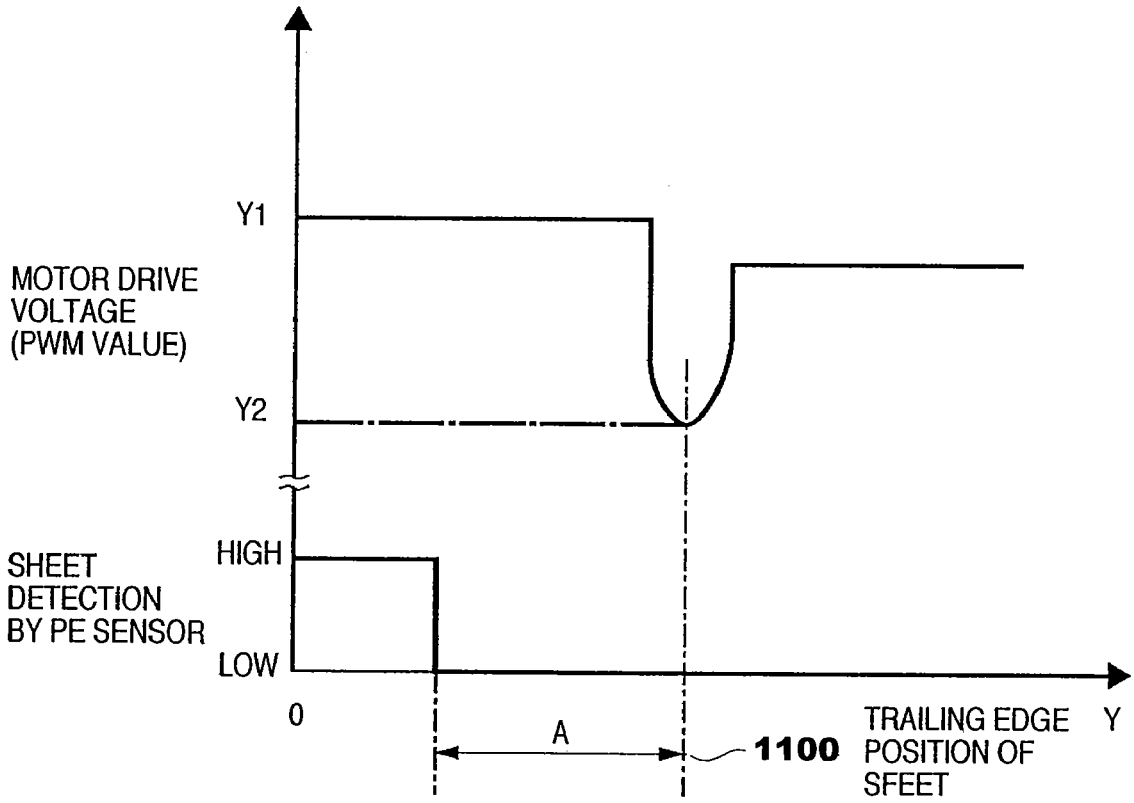
FIG. 11 depicts a view explaining a variation of a drive voltage of a LF motor when the trailing edge of the recording sheet P is released from the nip.
Figure 12A:
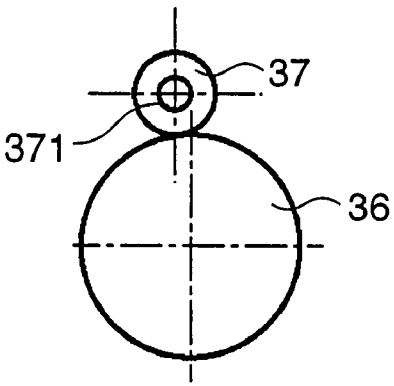
FIGS. 12A and 12B are views showing a relationship between a conveyance roller and a pinch roller in a conventional printer.
Figure 12B:
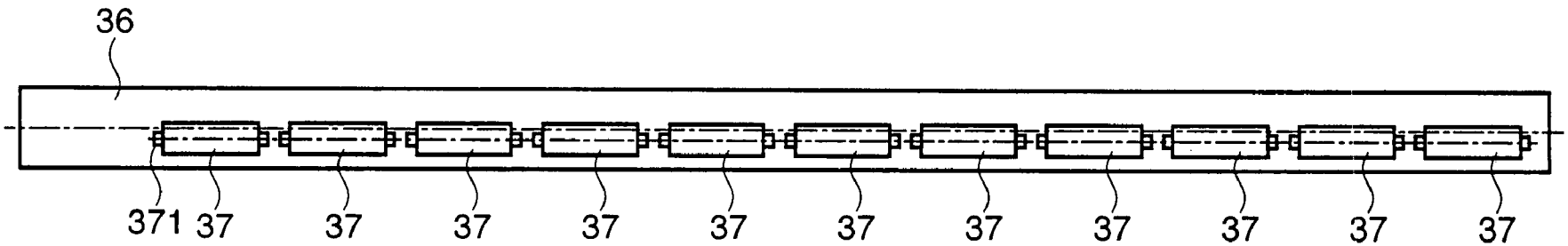

FIG. 11 depicts a view explaining a variation of the driving voltage of the LF motor 88 when the trailing edge of the recording sheet P is released from the nip 940.

When the trailing edge of the recording sheet P is released from the nip 940 of the conveyance roller 36 and the pinch roller 37, the end face of the trailing edge of the encoding sheet P is pushed by the pressing force of the pinch roller 37, and the conveyance roller 36 also receives a rotating force caused by the friction of the rear surface of the recording sheet. Therefore, the conveyance roller 36 is made to be driven by a force momentarily smaller than usual. Here, since the recording sheet P is controlled to be conveyed at a constant speed, the motor driving voltage at this time becomes small momentarily, as shown by the reference numeral 1100 in FIG. 11.

The variation of the drive voltage is inputted from the motor driver 111, so as to make it possible to accurately detect the passage of the recording sheet P through the nip 940. When the passage of the recording sheet P is detected, the process proceeds from step S15 to step S16, so that the counting of the detection signal from the encoder sensor 362 is ended. Then, in step S17, the counted value is written in the EEPROM 104. This enables the nip position information which is referred in step S4 in FIG. 8, to be stored as the number of the encoder signals from the time when the trailing edge of the recording sheet P passes the PE sensor lever 35 to the time when the trailing edge of the recording sheet P is released from the nip 940. As a result, when the printing of the recording sheet P is performed, it is possible to accurately detect the point of time when the trailing edge of the recording sheet P has been released from the nip 940 of the conveying roller pair 36, 37.

Then, in step S18, the recording sheet P is discharged to the discharge tray by rotating the discharge roller 41, and a series of operations are ended.

The nip position information thus obtained and peculiar to the printer is stored in the EEPROM 104 (storage means) in a nonvolatile state. As a result, in printing operations subsequently performed, it is possible to accurately and promptly determine for each recording sheet P whether the trailing edge of the recording sheet P is released from the nip.

The position at which the PWM value of the motor drive abruptly changes in the nip position in the present embodiment, may be detected slightly later than the position at which the trailing edge of the recording sheet P is actually released from the nip, depending on the configuration of the apparatus. In this case, a correction between the variation position of the PWM value and the nip position may be performed.

As explained above, according to the present embodiment, it is possible to form a high quality image at high speed without positional shift of dots in an image, by using the obtained nip position information.

Noted that in the above described embodiment, whether the recording sheet P passes the nip is arranged to be detected on the basis of the variation in the motor drive condition of the conveyance roller 36, but when a motor for driving the discharge roller 41 is separately provided, a variation of the drive voltage of the motor for driving the discharge roller may be detected to define the nip position.

Further, in the above described embodiment, the drive control of the motor is implemented by changing the PWM value of the driving voltage, but the drive current value of the motor may also be changed. In this case, a variation of the current value may be detected to define the nip position.

Further, the above described embodiment is explained by taking as an example a printer having a print head using a so-called bubble jet system in the ink-jet system. However, it is apparent from the explanation of each embodiment described above that the present invention is applicable to a printer having a print head other than such kind of print head. As the ink ejecting system of the print head, for example, a piezo system may be adopted in addition to the bubble jet system, and the present invention may also be applicable to a recording apparatus provided with a print head adopting a recording system other than the ink-jet system, in which recording elements are arranged in the print head, such as for example a thermal transfer system.

As explained above, according to present embodiment, an accurate nip position of a pair of rollers in conveying means for holding and conveying a recording medium is stored in a memory unit as a value specific to each printer P. Thereby, in a printing operation, it is possible to accurately and promptly determine the release of the trailing edge of the recording medium from the nip, by using the nip position information, and to perform accurately at high speed the image correction to around the trailing edge part of the recording medium, when the trailing edge of the recording medium is released from the nip.

As a result, it is possible to obtain a high quality printing result in all printing apparatuses without variations. Further, it is not necessary to improve the conveyance accuracy of the recording medium by providing load torque for the conveying means by a brake and the like, as a result of which the printing apparatus can be constituted in a small size at a low cost.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-322576 filed on Nov. 5, 2004, which is hereby incorporated by reference herein.

What is claimed is:

1. A recording apparatus for recording an image on a recording sheet held between rollers and conveyed by the rollers, comprising:

a recording head having a plurality of recording elements arranged in a conveyance direction of the recording sheet;

a first pair of rollers configured to hold and convey the recording sheet on an upstream side of a recording position in a conveyance path of the recording sheet;

a conveyance roller constituting a part of said first pair of rollers, configured to convey the recording sheet;

roller driving means for rotating said conveyance roller;

electric power detection means for detecting a variance of an electric power for driving said roller driving means, when the trailing edge of the recording sheet is released from a nip of said first pair of rollers; and head driving means for driving the recording head, to shift the recording elements of the recording head which are to be used, to a downstream side, when said electric power detection means detects the variance of the electric power.

2. The apparatus according to claim 1, further comprising storage means for storing a predetermined value corresponding to positional information of the recording sheet, when said electric power detection means detects the variance of the electric power, wherein said head driving means drives the recording head, to shift the recording elements of the recording head which are to be used, to the downstream side by the number of the recording elements corresponding to the predetermined value stored in said storage means.

3. The apparatus according to claim 2, further comprising trailing edge detection means for detecting the trailing edge of the recording sheet being conveyed in the conveyance path, wherein the predetermined value stored in said storage means is a value corresponding to a distance in which the recording sheet is conveyed from at a time when said trailing edge detection means detects the trailing edge of the recording sheet, to a time when the trailing edge of the recording sheet has been released from the nip of the first pair of rollers.

4. The apparatus according to claim 3, further comprising an encoder sensor adapted to detect a driving condition of a driving motor which drives to rotate said first pair of rollers until the trailing edge of the recording sheet is released from the nip of said first pair of rollers after said trailing edge detection means detects the trailing edge of the recording sheet, wherein said storage means stores an output value of said encoder sensor, as the predetermined value corresponding to a distance in which the recording sheet is conveyed from at a time when said trailing edge detection means detects the trailing edge of the recording sheet, to a time when the trailing edge of the recording sheet has been released from the nip of the first pair of rollers, wherein said trailing edge detection means detects a point of time when the trailing edge of the recording sheet is released from the nip of said first pair of rollers, on the basis of the output value stored in said storage means after said trailing edge detection means detects the trailing edge of the recording sheet.

5. The apparatus according to claim 3, further comprising recording control means for changing a recording process of the recording head after said trailing detection means detects the trailing edge of the recording sheet.

6. The apparatus according to claim 1, wherein said electric power detection means detects a variation of voltage for driving said roller driving means.

7. The apparatus according to claim 1, wherein said electric power detection means detects a variation of current for driving said roller driving means.

8. The apparatus according to claim 1, further comprising a second pair of rollers for holding and conveying the recording sheet on the downstream side of the recording position, wherein the recording sheet is held by said first pair of rollers and/or said second pair of rollers.

9. The apparatus according to claim 1, further comprising a pinch roller constituting a part of said first pair of rollers, configured to be driven to rotate in accordance with rotation of the conveyance roller.

10. The apparatus according to claim 1, wherein said head driving means shifts the recording elements of the recording head in correspondence to an integer multiple of a conveyance amount of the recording sheet at each scanning of the recording head.

11. A control method of a recording apparatus for holding and conveying a recording sheet, and for performing recording by a recording head having a plurality of recording elements arranged in a conveyance direction of the recording sheet, said control method comprising:

a conveyance control step for conveying and driving the recording sheet by increasing a conveyance amount of the recording sheet by a predetermined amount, when the trailing edge of the recording sheet is released from a nip of a first pair of rollers which hold and convey the recording sheet on an upstream side of a recording position in the conveyance path of the recording sheet;

an electric power detection step of detecting a variance of an electric power for driving the first pair of rollers, when the trailing edge of the recording sheet is released from the nip of the first pair of rollers; and a head driving step of driving the recording head, to shift the recording elements of the recording head which are to be used, to a downstream side, when in said electric power detection step, the variance of the electric power is detected.

12. The method according to claim 11, further comprising a storage step of storing a predetermined value corresponding to positional information of the recording sheet, when in said electric power detection step, the variance of the electric power is detected, wherein in said head driving step, the recording head is driven, to shift the recording elements of the recording head which are to be used, to the downstream side by the number of the recording elements corresponding to the predetermined value stored in said storage step.

13. The method according to claim 12, further comprising a trailing edge detection step of detecting the trailing edge of the recording sheet being conveyed in the conveyance path, wherein the predetermined value stored in said storage step is a value corresponding to a distance in which the recording sheet is conveyed from at a time when in said trailing edge detection step, the trailing edge of the recording sheet is detected, to a time when the trailing edge of the recording sheet has been released from the nip of the first pair of rollers.

14. The method according to claim 13, wherein in said storage step, an output value of an encoder sensor is stored as the predetermined value corresponding to a distance in which the recording sheet is conveyed from at a time when in said trailing edge detection step, the trailing edge of the recording sheet is detected, to a time when the trailing edge of the recording sheet has been released from the nip of the first pair of rollers, wherein the encoder sensor detects a driving condition of a driving motor which drives to rotate the first pair of rollers until the trailing edge of the recording sheet is released from the nip of said first pair of rollers after the trailing edge of the recording sheet is detected in said trailing edge detection step, wherein a point of time when the trailing edge of the recording sheet is released from the nip of the first pair of rollers, is detected on the basis of the output value stored in said storage step after in said trailing edge detection step, the trailing edge of the recording sheet is detected.

15. The method according to claim 13, further comprising a recording control step of changing a recording process of the recording head after in said trailing detection step, the trailing edge of the recording sheet is detected.

16. The method according to claim 11, wherein in said electric power detection step, a variation of voltage for driving the first pair of rollers is detected.

17. The method according to claim 11, wherein in said electric power detection step, a variation of current for driving the first pair of rollers is detected.

18. The method according to claim 11, further comprising a step of holding and conveying the recording sheet on the downstream side of the recording position by a second pair of rollers and holding the recording sheet by the first pair of rollers and/or the second pair of rollers.

19. The method according to claim 11, further comprising a step of driving a pinch roller constituting one of the first pair of rollers to rotate in accordance with rotation of the conveyance roller.

20. The method according to claim 11, wherein in said head driving step, the recording elements of the recording head are shifted in correspondence to an integer multiple of a conveyance amount of the recording sheet at each scanning of the recording head.

21. A recording apparatus for recording an image on a recording sheet held between rollers and conveyed by the rollers, comprising:

a recording head having a plurality of recording elements arranged in a conveyance direction of the recording sheet;

a first pair of rollers configured to hold and convey the recording sheet on an upstream side of a recording position in a conveyance path of the recording sheet;

a conveyance roller constituting a part of said first pair of rollers, configured to convey the recording sheet;

roller driving means for rotating said conveyance roller;

electric power detection means for detecting a variance of electric power for driving said roller driving means, in a case that a trailing edge of the recording sheet is released from a nip of said first pair of rollers;

control means for conveying the recording sheet by a second conveyance amount larger than a first conveyance amount in which the trailing edge of the recording sheet has been released from the nip of said first pair of rollers, in a case that said electric power detection means detects the variance of the electric power; and head driving means for driving the recording head, to shift the recording elements of the recording head which are used for recording to a downstream side by a difference between the second conveyance amount and the first conveyance amount to drive the recording head.

* * * * *

UNITED STATES PATENT AND TRADEMARK OFFICE

CERTIFICATE OF CORRECTION

PATENT NO. : 7,413,361 B2
APPLICATION NO. : 11/256109
DATED : August 19, 2008
INVENTOR(S) : Kawaguchi It is certified that error appears in the above-identified patent and that said Letters Patent is hereby corrected as shown below:

IN THE DRAWINGS:
Sheet No. 8, Figure 8, “SFEET” should read --SHEET--.

COLUMN 1:
Line 60, “effect that load increase” should read --effect that the load increase--.

COLUMN 2:
Line 22, “accordance to” should read --accordance with--.
Line 35, “provided with” should read --provided--.
Line 55, “provided with” should read --provided--.

COLUMN 3:
Line 61, “Noted” should read --Note--.

COLUMN 8:
Line 66, “of each all” should read --of each of all--.

COLUMN 9:
Line 3, “of each all” should read --of each of all--.

COLUMN 11:
Line 64, “Noted” should read --Note--.

COLUMN 12:
Line 16, “noted” should read --note--.

COLUMN 13:
Line 38, “Noted” should read --Note--.

COLUMN 14:
Line 61, “from at a time” should read --from a time--.

COLUMN 15:
Line 8, “from at a time” should read --from a time--.

UNITED STATES PATENT AND TRADEMARK OFFICE

CERTIFICATE OF CORRECTION

PATENT NO. : 7,413,361 B2
APPLICATION NO. : 11/256109
DATED : August 19, 2008
INVENTOR(S) : Kawaguchi It is certified that error appears in the above-identified patent and that said Letters Patent is hereby corrected as shown below:

COLUMN 16:
Line 11, “from at a time” should read --from a time--.
Line 18, “from at a time” should read --from a time--.

Signed and Sealed this

Twenty-seventh Day of January, 2009

JOHN DOLL
*Acting Director of the United States Patent and Trademark Office*